US011795026B2

(12) United States Patent
Patel

(10) Patent No.: US 11,795,026 B2
(45) Date of Patent: Oct. 24, 2023

(54) SERVO INDEXING TABLE FOR ROTARY AND HORIZONTAL SHIFTING OF PAPER BUNCH

(71) Applicant: Udaykumar Chhabildas Patel, Gujarat (IN)

(72) Inventor: Udaykumar Chhabildas Patel, Gujarat (IN)

( * ) Notice: Subject to any disclaimer, the term of this patent is extended or adjusted under 35 U.S.C. 154(b) by 168 days.

(21) Appl. No.: 17/423,021

(22) PCT Filed: Jan. 13, 2020

(86) PCT No.: PCT/IN2020/050038
§ 371 (c)(1),
(2) Date: Jul. 14, 2021

(87) PCT Pub. No.: WO2020/148778
PCT Pub. Date: Jul. 23, 2020

(65) Prior Publication Data

US 2022/0097999 A1 Mar. 31, 2022

(30) Foreign Application Priority Data

Jan. 14, 2019 (IN) ..... 201921001602

(51) Int. Cl.
*B65H 39/105* (2006.01)
*B42B 5/12* (2006.01)
*B42C 19/08* (2006.01)

(52) U.S. Cl.
CPC ..... *B65H 39/105* (2013.01); *B42B 5/126* (2013.01); *B42C 19/08* (2013.01);
(Continued)

(58) Field of Classification Search
CPC ..... B42B 5/126; B42C 19/08; B65H 2403/20; B65H 2403/30; B65H 2403/51;
(Continued)

(56) References Cited

U.S. PATENT DOCUMENTS 493,959 A * 3/1893 Arnold ..... B42C 11/04 412/4
1,085,888 A * 2/1914 Bredenberg ..... B42C 11/04 118/240

(Continued)

FOREIGN PATENT DOCUMENTS

CH 325096 A 10/1957
DE 1536508 2/1970

(Continued)

OTHER PUBLICATIONS

International Search Report for corresponding PCT Application No. PCT/IN2020/050038 dated Apr. 14, 2020.

*Primary Examiner* — Patrick H Mackey
(74) *Attorney, Agent, or Firm* — Caesar Rivise, PC

(57) ABSTRACT

The present invention relates to Indexer table (1) for rotary and horizontal shifting of paper bunches. Said indexer table (1) having spider arms shifted in rotary manner through pinion gear and servo motor. The drive power is provided to auxiliary shaft (5) from main shaft (4) through the pulley (11) and belt (19*d*) configuration. The juxtaposed shafts receive the drive power from the auxiliary shaft (5) through universal joints (10). The cam (12) on each shaft rotates along with rotation of the shaft for reciprocal movement of spider arm (20). The actuator (13) actuates follower (13*b*) for open and close movement of bunch gripper (21). Said bunch gripper (21) grips bunch paper and then said driven shaft (14) rotates so that the spider arm (20) shifts bunch paper in rotary manner. After performing operation of bunch paper, the spider arm (20) shifts bunch paper to next platform.

16 Claims, 11 Drawing Sheets

(52) U.S. Cl.
CPC ..... *B65H 2301/43826* (2013.01); *B65H 2403/20* (2013.01); *B65H 2403/30* (2013.01); *B65H 2403/51* (2013.01); *B65H 2403/92* (2013.01); *B65H 2557/64* (2013.01); *B65H 2801/48* (2013.01)

(58) Field of Classification Search
CPC ..... B65H 2403/92; B65H 2557/64; B65H 2801/48; B65H 39/105
See application file for complete search history.

(56) References Cited

U.S. PATENT DOCUMENTS

| | | | | | |
|---|---|---|---|---|---|
| 1,088,932 | A * | 3/1914 | Ritchie | B42C 11/04 | 412/19 |
| 4,237,569 | A * | 12/1980 | Muller | B42C 19/08 | 412/37 |
| 8,047,522 | B2 * | 11/2011 | Silberbauer | B42C 11/04 | 270/52.18 |
| 10,272,711 | B2 * | 4/2019 | Kubiak | B42C 11/04 | |
| 2002/0046813 | A1 * | 4/2002 | Merkli | B42C 9/0031 | 156/297 |

FOREIGN PATENT DOCUMENTS

| | | | |
|---|---|---|---|
| DE | 2101142 | A1 | 11/1984 |
| DE | 3415885 | A1 | 11/1984 |
| GB | 2141380 | A | 12/1984 |
| GB | 2113392 | A1 | 11/2009 |
| WO | WO79/00049 | | 2/1979 |

* cited by examiner

SERVO INDEXING TABLE FOR ROTARY AND HORIZONTAL SHIFTING OF PAPER BUNCH

CROSS-REFERENCE TO RELATED APPLICATIONS

This application is a U.S. National Phase Application under 35 U.S.C. § 371 of PCT/IN2020/050038, filed Jan. 13, 2020, which claims priority to India Patent Application No. 201921001602, filed Jan. 14, 2019.

FIELD OF INVENTION

The present invention relates to a spiral or double wire loop book binding machinery and more particularly it relates to an automatic spiral or double wire loop book binding machinery with servo indexing table which shifts the paper bunch from one station to another station in rotary and horizontal manner to make complete spiral or double wire loop notebook.

BACKGROUND OF THE INVENTION

Machines for spirally binding sheets of paper on a commercial scale are generally known in the art. This invention is related to paper converting machinery and similar kind of machines. The binding machines uses paper roll as input raw material. This machine performs different process on paper to convert it into complete spiral or wiro notebooks.

The sequence of operations for paper converting machine are, unwinding the paper from reel, printing on paper, cross cutting the paper based on the size of notebook, overlapping the paper sheet, counting the paper sheet, collecting the counted paper sheet, inserting cover pages, punching of bunch and separating the bunch which make number of books from one bunch based on number of ups, round corner, spiral or double wire loop binding and delivery of complete book.

As of now, there are two methods to carry out coil binding process: by pure manual labor and by machine. If it is carried out by pure manual labor, such method takes too much time and manpower and hence can not be used to carry out the binding for a large amount of books. Therefore, machine must be used to carry out the binding of a large amount of books. However, in the binding process by machine, the coil can not spin through the holes smoothly because the holes are not oriented at appropriate angle and curvature; therefore, such angle and curvature have to be manually formed at the binding edge before the coil spin through the holes, lowering the speed in the binding process and often resulting in inaccuracy in such angle and curvature.

Various prior arts have been disclosed describing the spiral or wiro book binding machinery. The prior art document US 2015/0086296 A1 describing about the production of books with wire or spiral bindings or other comparable bindings, wherein sub-layers made of punched sheets are collected one over the other in a successive manner into a book at a collecting station, and the book is subsequently bound. According to the invention, a sub-layer is held in a clamped manner by at least one lateral clamping device which moves together with the sub-layer while the sub-layer is transported into the collecting position, while the sub-layers already collected at the collecting station are held in a fixed manner by means of at least one needle which is moved upwards through the punched holes from below. The clamping of the pliers is released only when the needles are also located in the punched holes of the newly conveyed sub-layers as a result of the needles being moved upwards.

Moreover, the further prior art document U.S. Pat. No. 4,327,780 describing about the tool which loops the end portion of the outermost convolution of a spiral wire binder around the neigh boring next-to-the-outermost convolution while the convolutions of the binder extend through the perforations of a stack of paper sheets and the binder is located in a preselected position has a knife which trims the outermost convolution and thereupon bends the end portion of the outermost convolution to a position of parallelism with and proximity to a stationary surface. A looping device which is mounted at the forward end of a rotary reciprocal shaft is thereupon caused to engage the bent end portion in response to forward movement of the shaft and to loop the bent end portion by moving it along the surface and around the neighboring convolution in response to rotation of the shaft. The shaft is rotatable and reciprocal and the knife is movable by a set of coaxial cams which complete one revolution in order to affect trimming of the outermost convolution, to thereupon effect bending of the end portion of the trimmed convolution and to ultimately effect looping of the bent end portion. The cams are rotatable by a rack and pinion drive through the medium of a one-way clutch.

However, abovementioned conventional spiral or wiro book binding machinery are complex in structure which having the binding operation is followed by various processes like punching of paper sheet, alignment of paper sheets etc.

The aforesaid conventional spiral or wire binding machines encounter various problems which lead into the difficulties like this operations carried in linear and vertical manner. In linear type of configuration, it leads to lengthy type of machine structure.

In vertical method, shifting of the punched bunch for making the spiral or wire notebook is operating vertically (horizontal axis rotation). The main drawback of this conventional method is maintenance and setting of machine parameters are not user friendly also it takes longer time and skilled operator required. Another problem of the conventional machinery is that the spiral and wire binding process have different assemblies. As in the present invention the spiral and wire binding process handled simultaneously on the same unit.

Hence, it is desperately needed to introduce a bunch indexer unit that conveniently shifts the paper bunch for carrying out various operations.

OBJECTS OF INVENTION

The main object of present invention is to provide bunch indexer table that shift the punched paper bunch from one station to another station in rotary and horizontal manner.

Another object of present invention is to provide a bunch indexer table that provides facility for carrying out various operations of bunch of paper sheets i.e. book bunch collecting, bunch correction, spiral binding, spiral wire end cutting and bending, double wire loop binding, book delivery.

Further object of present invention is to provide bunch indexer unit that enable the ease of maintenance for all surrounding unit for different operation, provide more space for setting the different parameters from different unit and having user friendly and unique design.

One more object of the invention is that is to provide bunch indexer unit that is facilitated to visualize each operation happening at surrounding the operation and hence, the quality of the product can be improved.

SUMMARY OF INVENTION

The present invention relates to an Indexer table for rotary and horizontal shifting of paper bunches. According to present invention, said table mainly comprises a stationary platform having a top plate and a bottom plate being connected by plurality of vertical posts by defining space therebetween; a drive unit being accommodated within said space; said top plate and said bottom plate having central aperture respectively. Said drive unit includes servo motor drive unit having a pinion gear for indexing of bunch, a main shaft having a pulley being in mechanical connection with the first pulley and a cam, an auxiliary shaft having a pulley being in mechanical connection with the second pulley and a cam, juxtaposed shafts that receives drive power from said auxiliary shaft, a vertically driven shaft having lower end received within the central aperture of the bottom plate and extended from central aperture of the top plate, a spider head mounted on the top end of said driven shaft, spider arms located at regular distance and radially extended from the said spider head; each said spider arm having gripper at its free end. Each spider arm picks the paper bunch from Punched Paper Bunch Collecting Station through the gripper and shifts the paper bunch to subsequent stations in rotary manner. At each platform, one station is located in order to perform operation i.e. bunch correction, spiral binding and cutting, double wire loop binding and book delivering. The bunch indexer table shifts the bunch paper before every station. The bunch indexer unit of present invention provides multifold benefits to industries and end users which will be apparent from the following description.

BRIEF DESCRIPTION OF DRAWINGS

Other objects, advantages and novel features of the invention will become apparent from the following detailed description of the present embodiment when taken in conjunction with the accompanying drawings.

DETAILED DESCRIPTION OF THE INVENTION

Figure 1:
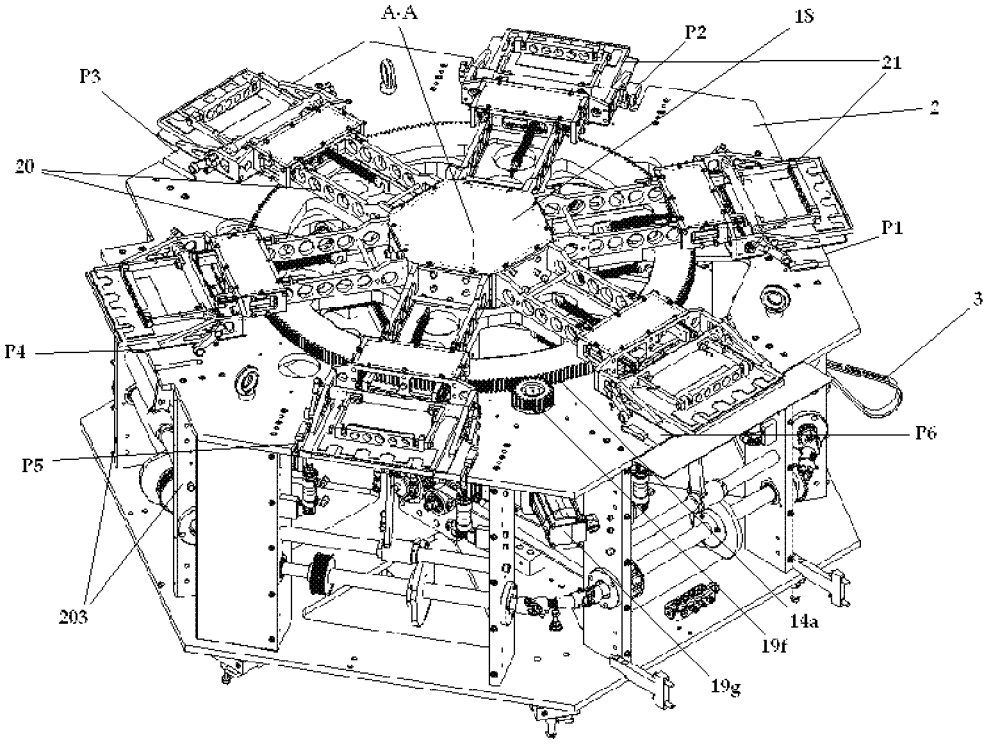
FIG. 1 shows a schematic diagram of the servo indexing table according to present invention.

Before explaining the present invention in detail, it is to be understood that the invention is not limited in its application to the details of the construction and arrangement of parts illustrated in the accompany drawings. The invention is capable of other embodiments, as depicted in different figures as described above and of being practiced or carried out in a variety of ways. It is to be understood that the phraseology and terminology employed herein is for the purpose of description and not of limitation.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

It is to be also understood that the term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Before explaining the present invention, it is to be noted that the bunch indexer unit for producing spiral and/or double wire loop bound paper products according to present invention may be installed into the reel to book binding machine or may be operated independently. It is to be also noted that, in the drawing, identical reference number identify similar element and acts.

Figure 2:
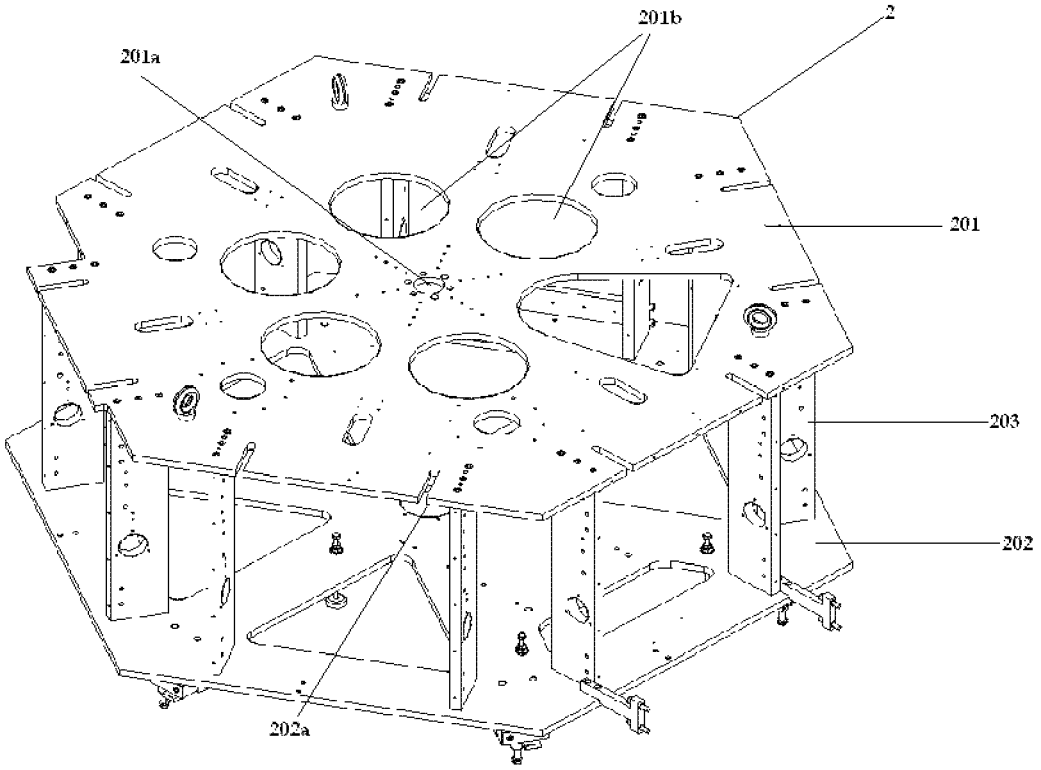
FIG. 2 shows schematic diagram of the stationary platform of the servo indexing station according to present invention.

Now, according to exemplary embodiment shown in FIGS. 1 and 2, the paper bunch servo indexing table (1) according to present invention mainly comprises a stationary platform (2) and a drive unit (3) being accommodated within said stationary platform (2) for circulating the paper bunch (26) in rotary and horizontal manner and shifting the paper bunch from one platform to next platform for further operation. From FIG. 3, it can be seen that various stations i.e. book bunch collecting station (A), a bunch correction station (B), a spiral binding station (C), a spiral wire end cutting and bending station (D), a double wire loop binding station (E), a book delivery station (F) have been depicted surrounding said bunch indexer table (1) for performing spiral and double wire binding operation on the paper bunch. However, it is to be understood that the various other operations can be performed rather than described herein surrounding the bunch indexer table (1) according to present invention.

Referring continuous with FIG. 2, said stationary platform (2) comprises a top plate (201) and a bottom plate (202) being connected by plurality of vertical posts (203) by defining space therebetween wherein said drive unit (3) is accommodated. Said top plate (201) is provided with top central aperture (201*a*) and plurality of surrounding holes (201*b*) formed surrounding said top central aperture (201*a*).

Likewise, a bottom central aperture (202*a*) is also formed in the center of the bottom plate (202). Said top central aperture (201*a*) is concentric about the bottom center aperture (202*a*).

Figure 3:
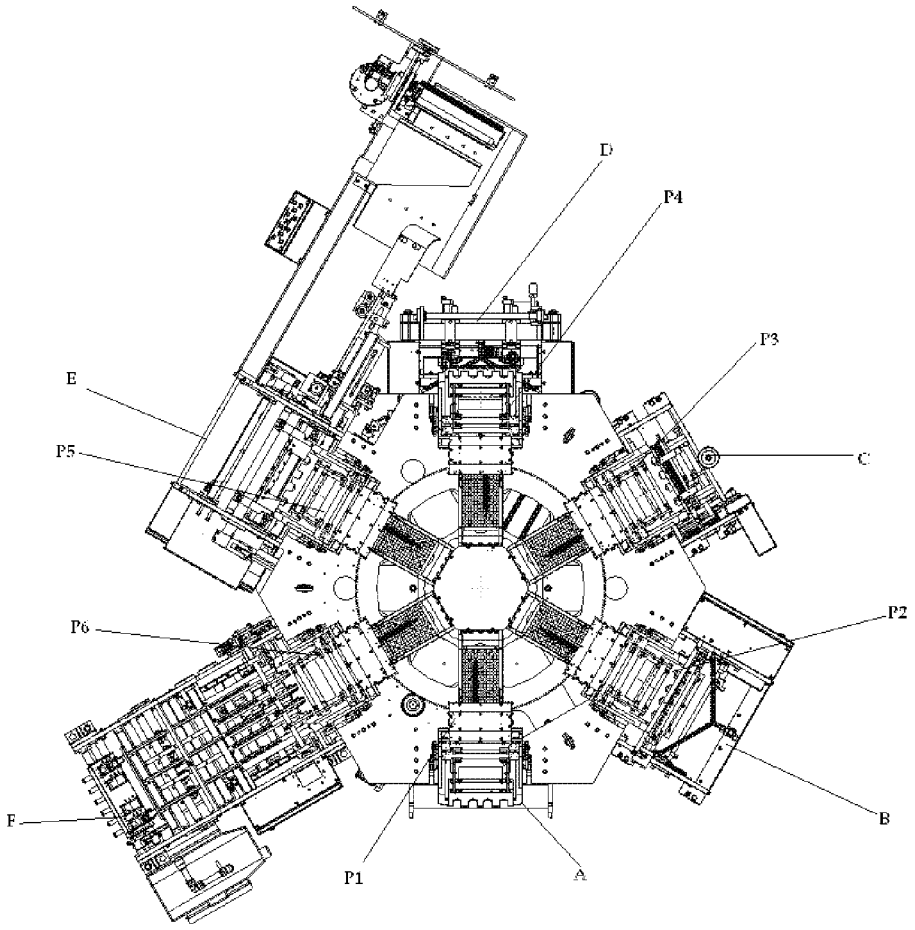
FIG. 3 shows the top view of the servo indexing table along with the stations located on periphery thereof according to present invention.
Figure 4:
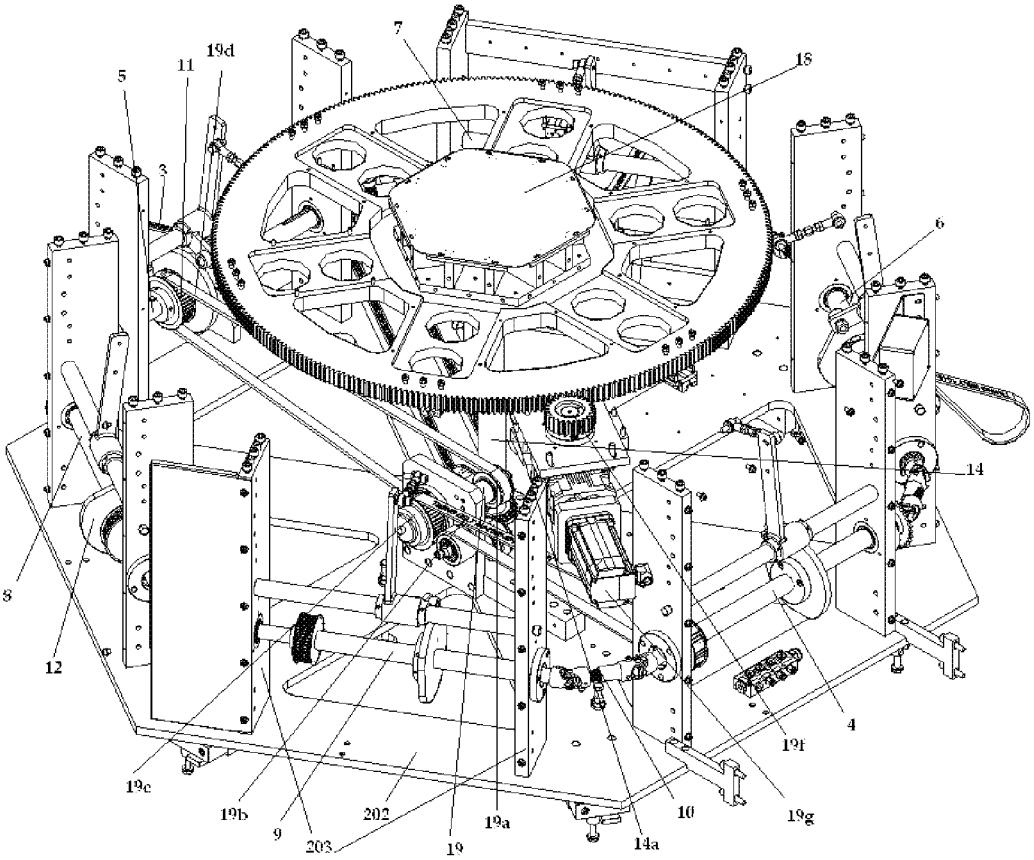
FIG. 4 shows schematic diagram of the servo drive unit of the servo indexing table according to present invention.

The detailed view of the exemplary embodiment of the drive unit (3) is shown in FIG. 4. Now, referring to FIGS. 3 and 4, there is 6 pair of vertical posts (203) has been shown that forms 6 platforms (P1-P6). At each platform, corresponding station (A-F) is located respectively for performing different operation on the paper bunch (As shown in FIG. 3). Now, according to an exemplary embodiment of the present invention as shown in FIG. 3, at platform P1, a punch paper bunch collecting station (A) is located that act as input to the indexing table. At platform P2, a book bunch correction unit is located. At platform P3, a spiral wire binding station is located. At platform P4, spiral wire end cutting and bending station is located. At station P5, double wire loop binding station is located and at platform P6, a book delivery station is located. The book indexing table of the proposed invention shifts or index the paper bunch from one station to another station in the manner as described below in detailed.

Referring continuous with FIG. 4, said drive unit (3) comprises a main shaft (4) extended between the pair of vertical posts (203) of the platform P1, an auxiliary shaft (5) extended between the pair of vertical posts (203) of the platform P4 and being driven by said main shaft (4) in the manner as described below, juxtaposed shafts (6, 7, 8) extended between the pair of vertical posts (203) of the platform (P2, P3, P5) respectively, each said juxtaposed shaft (6, 7, 8) is driven by the auxiliary shaft (5) through respective universal joints (10). Referring continuous with FIG. 4, said auxiliary shaft (5) drivably connected with juxtaposed shaft (7, 8) at its respective end through the universal joints (10). Further, free end of said juxtaposed shaft (7) is coupled with juxtaposed shaft (6). Further, free end of said mail shaft (4) is coupled with a juxtaposed shaft (9) through respective universal joints (10). Thus, the rotary motion of the auxiliary shaft (5) is transferred to the juxtaposed shafts (6, 7, 8) through the arrangement of the universal joints (10).

Figure 5:
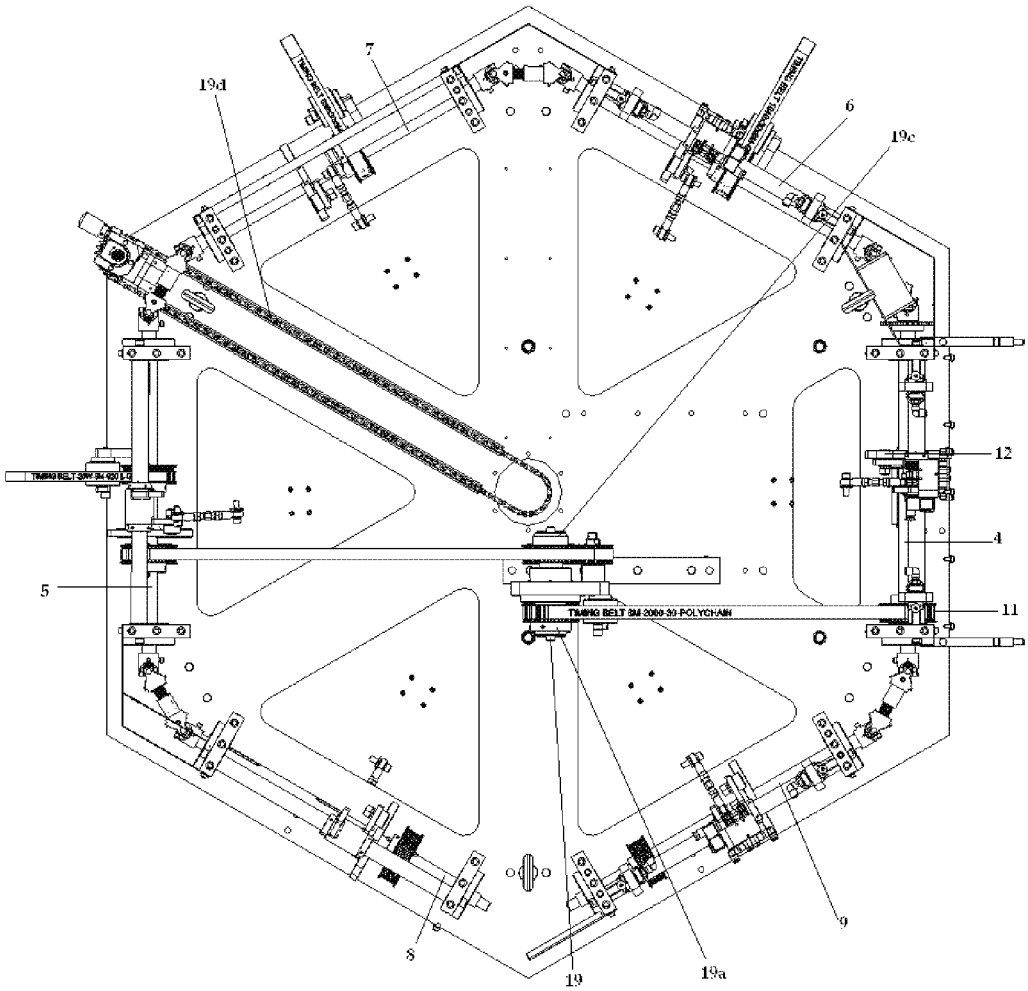
FIG. 5 shows the working principle of the drive distribution of the servo indexing table according to present invention.
Figure 6:
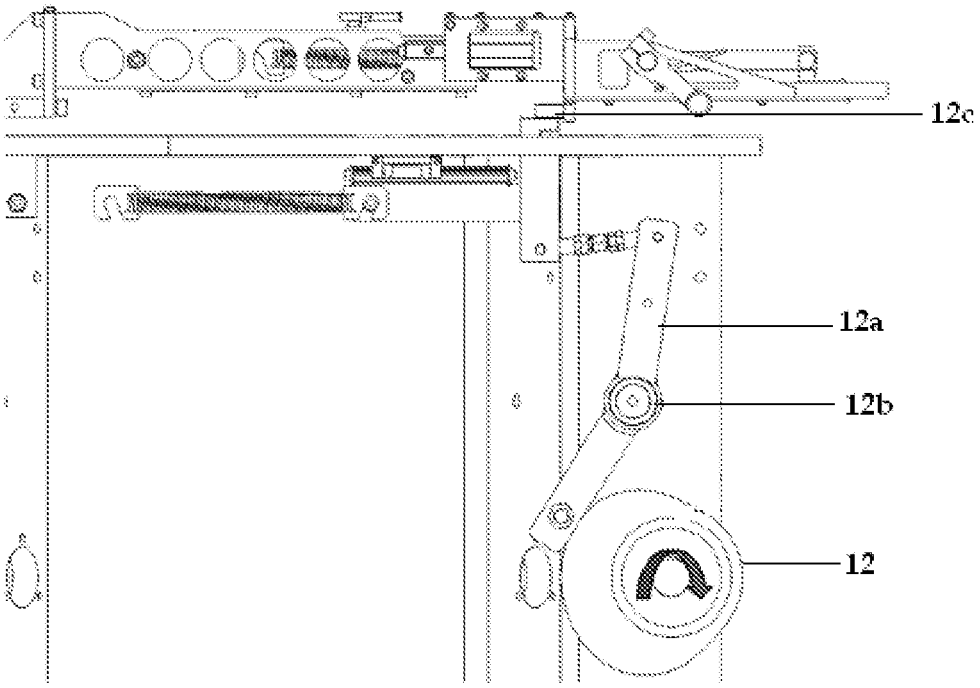
FIG. 6 shows to and fro mechanism of the spider arms according to present invention.
Figure 7:
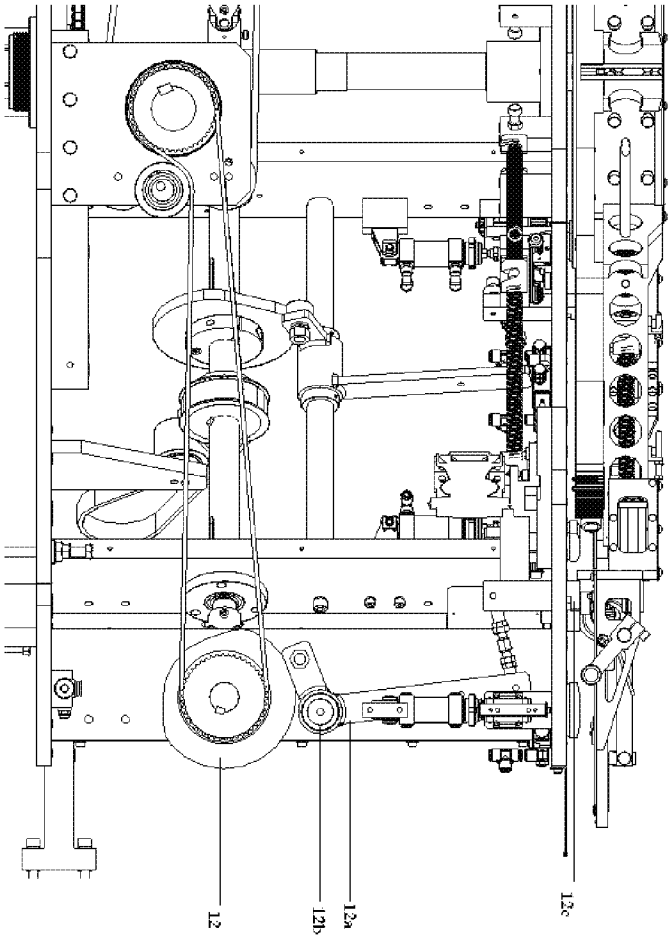
FIG. 7 shows to and fro mechanism of the spider arms according to present invention.
Figure 8:
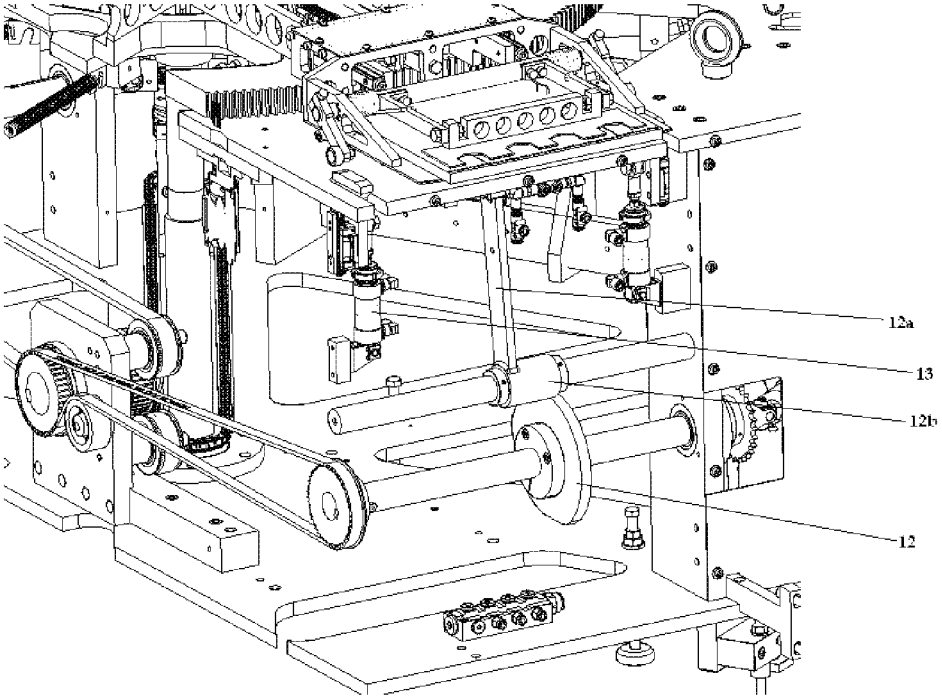
FIG. 8 shows open and close mechanism of the griper of the spider arm according to present invention.

Referring now to FIGS. 4 and 5 in combination, said main shaft (4) and the auxiliary shaft (5) are provided with a pulley (11) and a cam (12) located along their length. The input drive power is provided to the main shaft (4) and the auxiliary shaft (5) that transfers the drive to the further platform (P1-P6) in the manner as described below. Further, each juxtaposed shaft (6, 7, 8, 9) is also provide with a cam (12) along its length. Further, as shown in FIGS. 6, 7 and 8, each said cam (12) having a cam operated lever (12*a*) with fulcrum (12*b*) being operably connected to a follower (12*c*). Said follower (12*c*) is spring loaded and guided in linear bearing caused by rotation of the cam (12). Further, an actuator (13) is provided in proximity of each cam operated lever (12*a*). Now referring to FIG. 7, 8 in combination with FIG. 9, said actuator (13) is operatively connected to a spring loaded follower (13*b*) through a lever (13*a*). Said actuator (13) operates the lever (13*a*) which is moving with reference to a fulcrum (13*c*). Said lever (13*a*) actuates the spring loaded follower (13*b*) in up and down direction.

Figure 10:
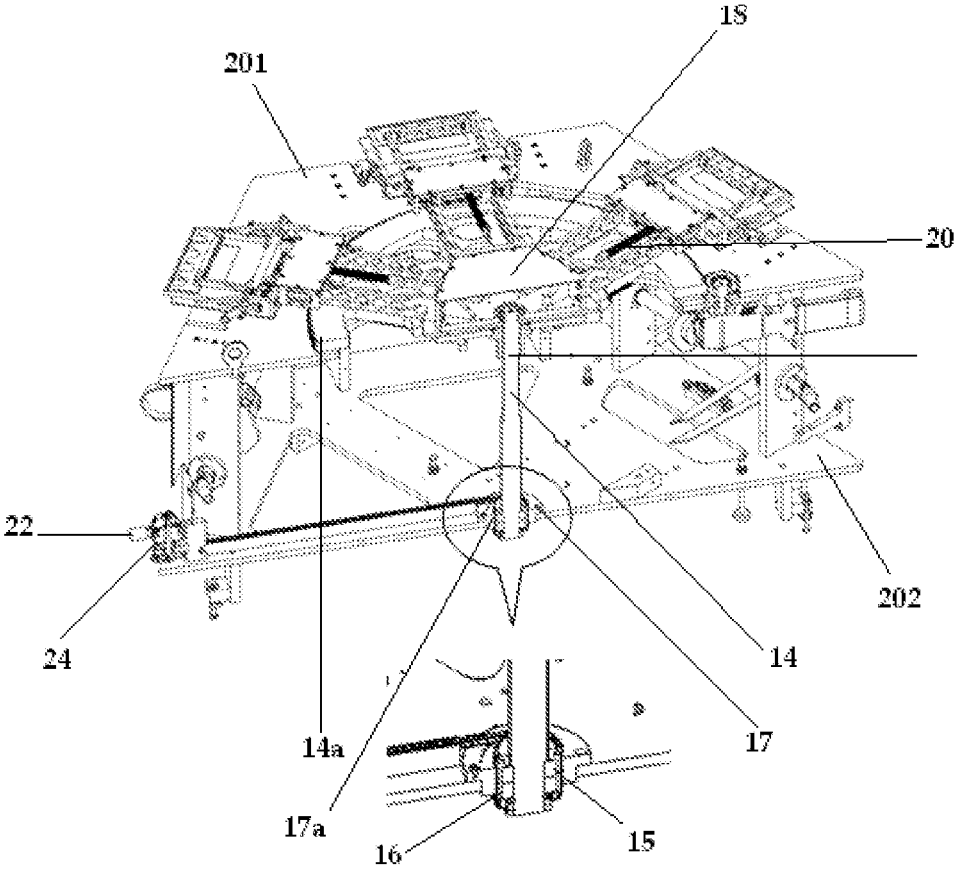
FIG. 10 shows mechanism for up and down movement of the driven shaft according to present invention.

Referring again to FIG. 4, said drive unit (3) comprises a vertical driven shaft (14), a lower end of which is rotatably received within the centre aperture (202*a*) of the bottom plate (202) with fixed nut (15) and movable screw (16) (as shown in FIG. 10) with chain sprocket (17) type configuration as described below in detail and an upper end is rotatably extended from the centre aperture (201*a*) of the top plate (201). From FIG. 4, it is seen that the top end of said vertically driven shaft (14) is extended with respect to the plan of the top plate (201) and a spider head (18) is mounted on the top end of said driven shaft (14). Further, said drive unit comprises a pinion gear (19*f*) mounted on a servo motor (19*g*), an intermediate shaft (19) having a first pulley (19*a*) and a second pulley (19*c*) being mounted along the length thereof, a vertical drive shaft (14) includes a spur gear (14*a*) which is driven by the servo motor (19*g*) that rotates vertical main drive shaft at pre-defined rotating angle with respect to a central axis (A-A).

Referring again to FIG. 4, the drive power rendered to the main shaft (4) is provided to the intermediate shaft (19) through the mechanical connection between the first pulley (19*a*) and the pulley (11) of the main shaft (4). Then, from the intermediate shaft (19), the drive is transferred to the pulley (11) of the auxiliary shaft (5) through the second pulley (19*c*). Afterwards, the drive power is transferred to juxtaposed shaft (6, 7, 8, 9) through the universal joints (11) respectively for shifting the paper bunch in horizontal rotary motion in synchronize manner. It is to be understood that the drive power may be rendered to the pulley (11) of the main shaft (4) by synchronizing with the previous operative unit of the book binding machine or may be provided by independent mechanical arrangement.

Referring back to FIG. 1, said spider head (18) having spider arms (20) being disposed at regular distances and radially extended outwardly over the top plate (201) with respect to the central axis (A-A). From FIG. 1, it can be seen that each said platform (P1-P6) operates one spider arm (20). Each said spider arm (20) passes over the surrounding holes (201*b*) of the top plate (201) and having a paper bunch gripper (21) coupled at the free end thereof. It is to be understood that in the present embodiment, six spider arms (20) are shown. However, it is within the scope of present invention to increase or decrease the numbers of spider arm (20) as per end user requirement.

Figure 11:
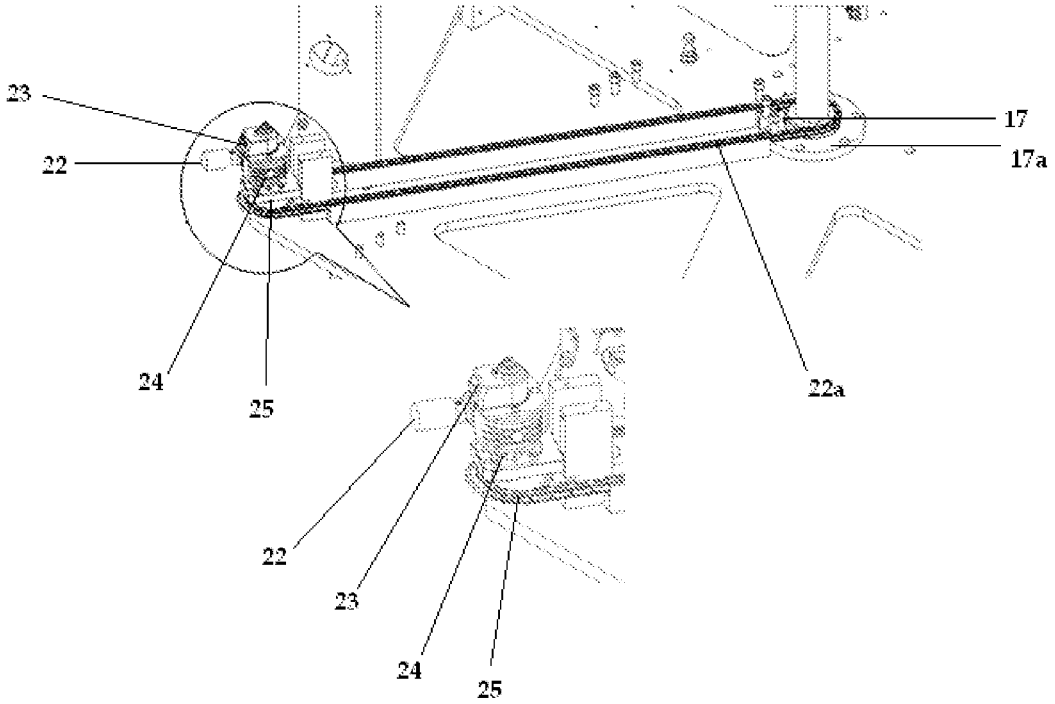
FIG. 11 shows the mechanism for up and down movement of the driven shaft through the hand wheel according to present invention.

Now referring to FIGS. 10 and 11, an arrangement of hollow screw (16) with bearing and nut (15) is mounted through a flange (17*a*) in the bottom central aperture (202*a*) of the bottom plate (202). The lower end of said driven shaft (14) is received within said aperture. Said screw (16) is in built with the chain sprocket (17) which is being mechanically connected to a book thickness adjustment mechanism through a sprocket (25) through an endless chain (22*a*). Said book thickness adjustment mechanism comprises a knurling knob (22) with sprocket (25), a book thickness indicator (23) and a rotation locking arrangement (24). According to the thickness of the paper bunch to be gripped, the up and down movement of the spider head (18) is required to be set in order to grip the paper bunch (26) of desired thickness. In order to achieve this objective, the hand wheel (22) rotates the chain sprocket (17) of the screw (16) through the sprocket (25) that enables the driven shaft (14) to move up and down according to rotating direction of the screw (16). This configuration causes the spider head (18) and therefore the spider arms (20) to move up and down along with the movement of the driven shaft (14). Amount of rotation and direction of rotation can be decided based on the reading which is indicated by the indicator and which is showing the book thickness reading for which the up-down adjustment of spider head (18) is to be carried out.

Now, by aforementioned arrangement of the present embodiment, various operations like shifting of paper bunch from one station to another station, open and close movement of gripper (21) to pick and drop the gripped paper bunch and to and fro movement of spider arm (20) to carry and drop the bunch are performed which are described below in detailed.

Initially, after setting the gripper (21) of the spider arm (20), the To and Fro movement of the spider arms (20) is required to be carried out to move forward the gripper (21) for picking the bunch from one unit and then the gripper (21) of each spider arm (20) is actuated to pick the bunch (26) and then rotation of spider arms (20) is performed to shift the gripped bunch at next unit for next sequence of operation. Now, when the drive power is rendered to the main shaft (4), it is transferred to the auxiliary shaft (5) and the juxtaposed shafts (6, 7, 8) and (9) in the manner as described above through the universal joints (10) and. Thus, all the operations will be carried out at each platform (P1-P6) simultaneously.

Figure 9:
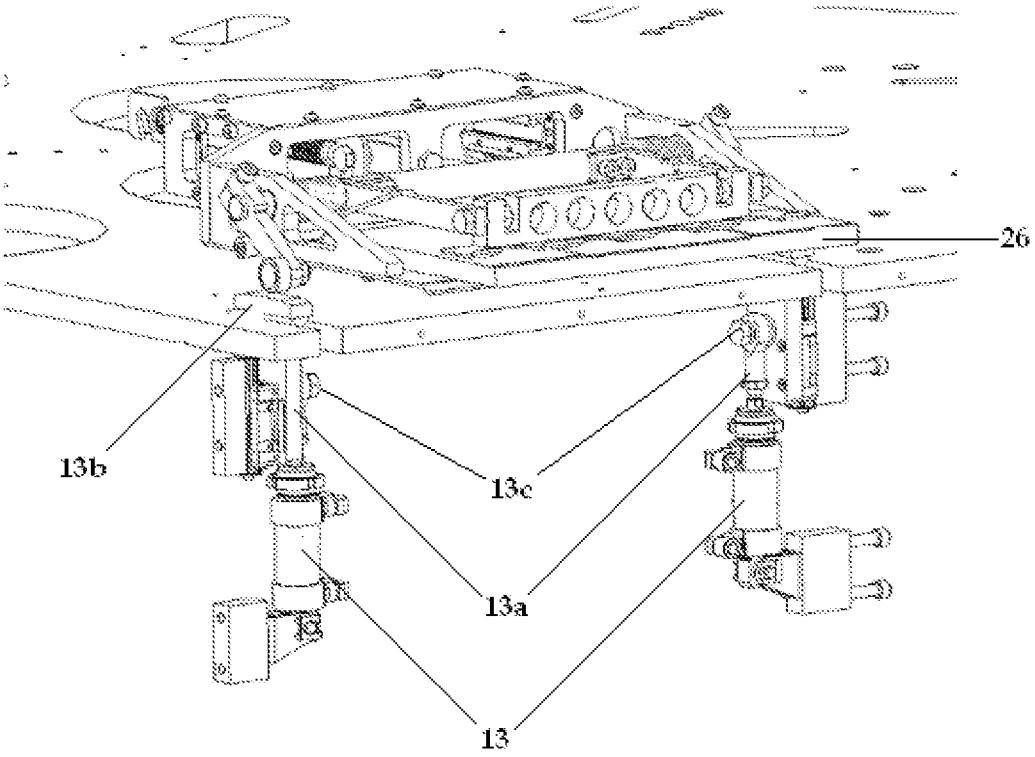
FIG. 9 shows the mechanism for gripping and dropping the paper bunch by the gripper of the spider arms according to present invention.

Now, said pulley (11) of the auxiliary shaft (5) receives the drive power from the main shaft (4) through the intermediate shaft (19). Meanwhile, said auxiliary shaft (5) transfer the drive to the juxtaposed shafts (6, 7, 8) with the help of the universal joints (10) and the juxtaposed shaft (9) receives power from shaft (4) with help of universal joint (10). Along with reacceptance of drive power, the cam (12) of each shaft is rotated. The rotation of said cam (12) is leading the pendulum movement of the said follower (12*c*), which is spring loaded and guided in linear bearing as shown in FIG. 6. The said follower (12*c*) pushes the spider arm (20) which is also guided in linear bearing and spring loaded as shown. Thus, each said spider arm (20) move towards the bunch. Then after, open and close movement of gripper (21) is required to grip the bunch. In order to perform this operation, as shown in FIGS. 8 and 9, the actuator (13) operates the lever (13*a*) which is moving with reference to fulcrum. The lever (13*a*) actuating the spring loaded follower (13*b*) in up and down direction and the movement of follower (13*b*) is leading the open and close movement of bunch gripper (21). Now, as the follower (13*b*) moves up, the gripper (21) gets open and after receiving paper bunch from punched paper bunch collecting station (A), the actuator (13) moves down the follower (13*b*) that cause gripper (21) to close to grip the paper bunch. After gripping the paper bunch, each spider arm (20) moves in reverse direction. It is to be understood that all these to and fro movements of spider arms (20) and open and close movements of the grippers (21) will be carried out at each platform (P1-P6) simultaneously.

After gripping of the paper bunch, the driven shaft (14) rotates for predefined rotating angle with the help of the servo motor (19*g*) which includes gear mechanism that cause to rotate the spider head (18) and therefore, the spider arms (20). It is to be understood that in present embodiment, it is shown that there are six operations are carried out on the paper bunch (as shown in FIG. 3). Hence, the rotation of the driven shaft (14) and the spider head (18) is set for 60° for shifting of bunch to next station through the spider arms (20). Thus, each spider arm (20) will be rotated 360° for completing one cycle (from station A to A). However, the degree of the rotation of the spider arms (20) may be set as per the numbers of the operations to be carried out.

Thus, after gripping bunch paper from bunch collecting station (A), the spider arm (20) will be shifted from platform P1 to the platform P2 and then next spider arm (20) will be shifted to platform P1. Thus, each spider arm (20) shifts to next station along with the rotation of the driven shaft (14). At platform P2, same sequence of activity will be performed by the spider arm (20) and the gripper (21). At platform P2, the book bunch correction unit (B) is installed. In this unit, the punched paper bunch holes are aligned properly before inserting to the next stations. After completion of working of unit B, the paper bunch is shifted to next station at platform P3 which is the spiral wire binding unit (C) where spiral binding of paper bunch is performed. Then after, the spiral biding paper bunch is shifted to the spiral wire end cutting and bending unit (D) at platform P4. The function of this station is to precisely cut the extra wire kept in previous station and bend the same towards the inside of spiral. Then after, the paper bunch (26) is shifted to the wire binding station (E) at platform P5. In this case, this unit will be remained deactivate. In contrast, in case of wire book binding production, this unit will be remain active and the spiral biding (C) and cutting unit (D) at platform P3 and P4 will remain deactivate. Afterwards, the spider arm (20) shifts the bunch to the book delivery stations (F) at platform (P6) for discharging the prepared spiral/wire binding books. It is to be understood that the aforesaid working operation of the present invention is explained with reference to the rotary shifting of the single spider arm (20). All such operations will be performed by each spider arm (20) at each station (A-F) simultaneously.

In this manner, the paper bunch (26) gripped by each spider arm (20) will be simultaneously shifted to each platform (P1-P6) in rotary manner and at each platform (P1-P6); the corresponding operations will be carried out by the corresponding stations.

According to the present example embodiments corresponding to FIGS. 1 to 11, there are six platforms (P1-P6) which are disposed uniformly on the rotary indexing table. With this, six workstations can be positioned at the periphery of the rotary indexing table, adjacent to the rotary indexing table. Due to the division, an angle 60°, relative to the axis of rotation of the rotary indexing table, results between two adjacent platforms. However, other divisions of the rotary indexing table can also be envisioned corresponding to the number of transfer workstations required in other cases. In this context it is mentioned that the term rotary index table is not limited to a circular contour, rather it comprises in particular also a contour of a regular rectangle or polygon.

The servo indexing table of the present invention is apparently advantageous over existing machine. Said the machine with simplified and unique design provides automation in book binding process, reduced pattern storage space requirements, ease operating machine and visualized surrounding operations.

The invention has been explained in relation to specific embodiment. It is inferred that the foregoing description is only illustrative of the present invention and it is not intended that the invention be limited or restrictive thereto. Many other specific embodiments of the present invention will be apparent to one skilled in the art from the foregoing disclosure. All substitution, alterations and modification of the present invention which come within the scope of the following claims are to which the present invention is readily susceptible without departing from the spirit of the invention. The scope of the invention should therefore be determined not with reference to the above description but should be determined with reference to appended claims along with full scope of equivalents to which such claims are entitled.

LIST OF REFERENCE NUMERALS

Bunch indexer table (1)
Stationary platform (2)
Top plate (201)
Top Central aperture (201*a*)

Surrounding holes (201*b*)
Bottom plate (202)
Bottom Central aperture (202*a*)
Vertical posts (203)
Drive unit (3)
Main shaft (4)
Auxiliary shaft (5)
Juxtaposed shaft (6, 7, 8, 9)
Universal joints (10)
Pulley (11)
Cam (12)
Cam operated lever (12*a*)
Fulcrum (12*b*)
Follower (12*c*)
Actuator (13)
Lever (13*a*)
Follower (13*b*)
Fulcrum (13*c*)
Driven shaft (14)
Spur gear (14*a*)
Nut (15)
Hollow screw (16)
Chain sprocket (17)
Flange (17*a*)
Spider head (18)
Intermediate shaft (19)
First pulley (19*a*)
Endless belt (19*b*)
Second pulley (19*c*)
Endless belt (19*d*)
Pinion gear (19*f*)
Servo motor (19*g*)
Spider arms (20)
Bunch gripper (21)
knurling knob (22)
Endless belt (22*a*)
Book thickness indicator (23)
Rotation locking arrangement (24)
Sprocket (25)
Paper Bunch (26)
Platforms (P1-P6)

I claim:

1. A servo indexing table for rotary and horizontal shifting of paper bunches comprising:

a stationary platform having a top plate and a bottom plate being connected by a plurality of vertical posts by defining space therebetween; a drive unit being accommodated within said space; said top plate and said bottom plate each having a central aperture;

said drive unit including a servo motor, a pinion gear mounted on the servo motor, an intermediate shaft having a first pulley and a second pulley being mounted along a length thereof, a main shaft having a pulley mechanically connected with the first pulley of the intermediate shaft and a first cam, at least one auxiliary shaft having a pulley mechanically connected with the second pulley of the intermediate shaft and an auxiliary cam, juxtaposed shafts each having a respective juxtaposed cam and that are suitable for receiving drive power from said auxiliary shaft, a vertically driven shaft having a lower end received within the central aperture of the bottom plate and a top end being extended from the central aperture of the top plate, a spider head mounted on the top end of said driven shaft, spider arms located at regular distance and radially extended from the spider head; each one of the spider arms having a gripper at its free end;

the driven shaft being rotatable for a predefined rotating angle with help of the servo motor which includes gear mechanism suitable for causing the spider head and therefore, the spider arms to rotate;

the drive power renderable to the main shaft by the servo motor is providable to the intermediate shaft through a mechanical connection between the first pulley and the pulley of the main shaft, wherein from the intermediate shaft, the drive is transferable to the pulley of the auxiliary shaft through the second pulley, and wherein the drive power is transferable to the juxtaposed shafts through universal joints respectively for shifting the paper bunch in horizontal rotary motion in synchronized manner.

2. The servo indexing table for rotary and horizontal shifting of paper bunches as claimed in claim 1, wherein one end of at least one of said juxtaposed shafts is coupled with a respective end of the auxiliary shaft, and a free end of one of the juxtaposed shafts is coupled to another one of the juxtaposed shafts through a universal joint and a free end of the main shaft is coupled to yet another one of the juxtaposed shafts through a universal joint.

3. The Servo Indexing table for rotary and horizontal shifting of paper bunches as claimed in claim 1, wherein a spur gear is mounted along the driven shaft.

4. The Servo Indexing table for rotary and horizontal shifting of paper bunches as claimed in claim 1, wherein the cam of each shaft having a cam operated lever with fulcrum and a spring loaded follower located below each one of the spider arms.

5. The Servo Indexing table for rotary and horizontal shifting of paper bunches as claimed in claim 1, wherein an actuator is located below each one of the spider arms and in proximity of said cam operated lever.

6. The Servo Indexing table for rotary and horizontal shifting of paper bunches as claimed in claim 5, wherein said actuator actuates a follower in up and down direction through an actuator lever.

7. The Servo Indexing table for rotary and horizontal shifting of paper bunches as claimed in claim 1, a lower end of said driven shaft fitted with a hollow screw with bearing and nut being mounted through a flange in the central aperture of the bottom plate.

8. The Servo Indexing table for rotary and horizontal shifting of paper bunches as claimed in claim 7, said screw having a chain sprocket.

9. The Servo Indexing table for rotary and horizontal shifting of paper bunches as claimed in claim 1, wherein said drive unit includes a book thickness adjustment mechanism.

10. The Servo Indexing table for rotary and horizontal shifting of paper bunches as claimed in claim 9, wherein the book thickness adjustment mechanism has a knurling knob with sprocket, a book thickness indicator and a rotation locking arrangement.

11. The Servo Indexing table for rotary and horizontal shifting of paper bunches as claimed in claim 10, wherein said sprocket is rotatably driven by said knurling knob.

12. The Servo Indexing table for rotary and horizontal shifting of paper bunches as claimed in claim 10, wherein said sprocket is in mechanical connection with the chain sprocket through an endless belt.

13. A method for rotary and horizontal shifting of the paper bunches, comprising:

a) adjusting a driven shaft by performing up and down movement by rotating a knurling knob according to a thickness of a paper bunch to be gripped;

b) providing drive power to a pulley of a main shaft;

c) transferring the drive power to an auxiliary shaft from the main shaft through an intermediate shaft;
d) transferring the drive power to a first juxtaposed shaft from the auxiliary shaft through universal joints and transferring drive power to a second juxtaposed shaft from the main shaft through the universal joints;
e) rotating a cam on each shaft;
f) moving each spider arm in forward direction by pushing a follower through a cam operated lever of the cam;
g) moving up the follower through an actuator lever by an actuator for opening a gripper of each spider arm;
h) gripping the paper bunch from a station by the gripper and moving each spider arm in reverse direction linearly;
i) rotating the driven shaft through a servo motor for 60° relative to an axis of rotation;
j) shifting each spider arm from the station to a next station.

14. The method for rotary and horizontal shifting of paper bunches as claimed in claim 13, wherein a pulley of the intermediate shaft is in mechanical connection with the pulley of the main shaft.

15. The method for rotary and horizontal shifting of paper bunches as claimed in claim 13, wherein a pulley of the intermediate shaft is in mechanical connection with a pulley of the auxiliary shaft.

16. A method for rotary and horizontal shifting of paper bunches using a servo indexing table including a stationary platform having a top plate and a bottom plate being connected by a plurality of vertical posts by defining space therebetween, a drive unit being accommodated within the space, the top plate and the bottom plate each having a central aperture, the drive unit including a servo motor, a pinion gear mounted on the servo motor, an intermediate shaft having a first pulley and a second pulley being mounted along a length thereof, a main shaft having a pulley mechanically connected with the first pulley of the intermediate shaft and a first cam, an auxiliary shaft having a pulley mechanically connected with the second pulley of the intermediate shaft and an auxiliary cam, juxtaposed shafts each having a respective juxtaposed cam and that are suitable for receiving drive power from the auxiliary shaft, a vertically driven shaft having a lower end received within the central aperture of the bottom plate and a top end being extended from the central aperture of the top plate, a spider head mounted on the top end of the driven shaft, spider arms located at regular distance and radially extended from the spider head, each one of the spider arms having a gripper at its free end, the driven shaft being rotatable for a predefined rotating angle with help of the servo motor which includes gear mechanism suitable for causing the spider head and therefore, the spider arms to rotate, the drive power renderable to the main shaft by the servo motor is providable to the intermediate shaft through a mechanical connection between the first pulley and the pulley of the main shaft, wherein from the intermediate shaft, the drive is transferable to the pulley of the auxiliary shaft through the second pulley, and wherein the drive power is transferable to the juxtaposed shafts through universal joints respectively for shifting one of the paper bunches in horizontal rotary motion in synchronized manner, the method comprising:

a) adjusting the driven shaft by performing up and down movement by rotating a knurling knob according to a thickness of a paper bunch of the paper bunches to be gripped;
b) providing drive power to the pulley of the main shaft;
c) transferring the drive power to the auxiliary shaft from the main shaft through the intermediate shaft;
d) transferring the drive power to one of the juxtaposed shafts from the auxiliary shaft through the universal joints and transferring drive power to another one of the juxtaposed shafts from the main shaft through the universal joints;
e) rotating the respective cam on each shaft;
f) moving each spider arm in forward direction by pushing a follower through a cam operated lever of the cam;
g) moving up the follower through an actuator lever by an actuator for opening the gripper of each spider arm;
h) gripping the paper bunch from a station by the gripper and moving each spider arm in reverse direction linearly;
i) rotating the driven shaft through the servo motor for 60° relative to an axis of rotation; and
j) shifting each spider arm from the station to a next station.

* * * * *